US008513926B2

(12) United States Patent
Park et al.

(10) Patent No.: US 8,513,926 B2
(45) Date of Patent: Aug. 20, 2013

(54) POWER FACTOR CORRECTION CIRCUIT AND DRIVING METHOD THEREOF

(75) Inventors: Young-Bae Park, Anyang (KR); Sang Cheol Moon, Bucheon (KR); Byoung Heon Kim, Bucheon (KR)

(73) Assignee: Fairchild Korea Semiconductor Ltd., Bucheon (KR)

( * ) Notice: Subject to any disclaimer, the term of this patent is extended or adjusted under 35 U.S.C. 154(b) by 351 days.

(21) Appl. No.: 12/912,181

(22) Filed: Oct. 26, 2010

(65) Prior Publication Data

US 2011/0095732 A1 Apr. 28, 2011

(30) Foreign Application Priority Data

Oct. 26, 2009 (KR) ..... 10-2009-0101679

(51) Int. Cl.
*G05F 5/00* (2006.01)

(52) U.S. Cl.
USPC ..... 323/207; 363/49; 363/89; 363/90; 363/97

(58) Field of Classification Search
USPC ..... 323/206, 207, 208, 222; 363/80, 363/82, 89, 90, 96, 97
See application file for complete search history.

(56) References Cited

U.S. PATENT DOCUMENTS

| | | | | |
|---|---|---|---|---|
| 4,872,104 | A | 10/1989 | Holsinger | |
| 7,538,525 | B2 * | 5/2009 | Kim et al. | 323/205 |
| 7,719,240 | B2 * | 5/2010 | Usui | 323/206 |
| 2005/0018458 | A1 * | 1/2005 | Shimada et al. | 363/125 |
| 2005/0219866 | A1 * | 10/2005 | Shimada | 363/16 |

* cited by examiner

*Primary Examiner* — Nguyen Tran
(74) *Attorney, Agent, or Firm* — Okamoto & Benedicto LLP

(57) ABSTRACT

The present invention relates to a power factor correction circuit and a driving method thereof. The power factor correction circuit receives an input voltage and maintains an output voltage at a constant level by controlling switching operation of a power switch connected to an inductor that supplies the output voltage. In this case, the power factor correction circuit controls switching operation of the power switch by differentiating a control structure for an output voltage respectively according to a stabilization period during which the output voltage is constantly maintained and a start-up period during which the output voltage is increased before being stabilized. In addition, the power factor correction circuit controls the switching operation of the power switch according to the control structure of the start-up period during a predetermined correction delay period from a time that the stabilization period starts.

17 Claims, 6 Drawing Sheets

POWER FACTOR CORRECTION CIRCUIT AND DRIVING METHOD THEREOF

CROSS-REFERENCE TO RELATED APPLICATION

This application claims priority to and the benefit of Korean Patent Application No. 10-2009-0101679 filed in the Korean Intellectual Property Office on Oct. 26, 2009, the entire contents of which are incorporated herein by reference.

BACKGROUND OF THE INVENTION (a) Field of the Invention

The present invention relates to a power factor correction circuit and a driving method thereof.

(b) Description of the Related Art

A control circuit of a typical power factor correction circuit (hereinafter, a power factor correction control circuit) receives a feedback voltage corresponding to an output voltage, and controls the output voltage according to the feedback voltage so as to keep the output voltage constant.

However, when a control response of the power factor correction circuit is too fast, a ripple of an input voltage is reflected to the output voltage so that it is difficult to maintain a good power factor.

Although unlikely, when the control response of the power factor correction circuit is slow, an over-shoot of the output voltage cannot be promptly responded to, thereby causing an over-voltage of the output voltage. In addition, when a fluctuation of a load connected to the power factor correction circuit or an unexpected increase of the input voltage are occurred, the power factor correction circuit cannot react to that because of slow response of the power factor correction circuit. Then, it is difficult to maintain the output voltage at a constant level.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a power factor correction circuit having advantages of preventing over-voltage of an output voltage and providing a constant output voltage, and a driving method thereof.

A power factor correction circuit according to an exemplary embodiment of the present invention includes an inductor, a power switch, and a power factor correction controller. The inductor receives an input voltage and supplies an output voltage, and the power switch is connected to the inductor and controls an inductor current flowing to the inductor. The power factor correction controller controls switching operation of the power switch by differentiating a control structure for an output voltage respectively according to a stabilization period during which the output voltage is constantly maintained and a start-up period during which the output voltage is increased before being stabilized. The power factor correction controller controls the switching operation of the power switch according to the control structure of the start-up period during a predetermined correction delay period from a time that the stabilization period starts. The control structure of the power factor correction controller during the start-up period is a proportional control method that controls the switching operation of the power switch according to the size of an output voltage error, and the output voltage error corresponds to a difference between an output voltage target level and a current output voltage of the power factor correction circuit. The control structure of the power factor correction controller during the stabilization period is a proportional-integral method that controls the switching operation of the power switch according to an integration result of the output voltage error.

The power factor correction controller according to the exemplary embodiment of the present invention includes an error amplification signal that generates an error amplification signal according to the output voltage error, and the error amplifying signal generator generates the error amplification signal according to the size of the output voltage error during a period in which an error voltage corresponding to the output voltage error is higher than a predetermined threshold voltage and a period from a time that the error voltage is lower than the threshold voltage to the correction delay period, and generates the error amplification signal by integrating the output voltage error after the correction delay period. The error amplifying signal generator includes: an error amplifier generating the output voltage error according to a difference between a division voltage corresponding to the output voltage and a reference voltage corresponding to the output voltage target level; an error amplifying signal corrector generating the error voltage by detecting the output voltage error and generating an error amplifying signal according to the size of the output voltage error during a period in which the error voltage is higher than the threshold voltage and the correction delay period; and a capacitor charged/discharged according to the output voltage error. The error amplifying signal is determined by a voltage charged at the capacitor after the correction delay period from a time that the error voltage is lower than the threshold voltage.

The error amplifying signal generator according to the exemplary embodiment of the present invention includes: a current detector generating a detection current corresponding to an output voltage error by detecting the output voltage error; a current mirror circuit generating a mirror current by mirroring the detection current with a predetermined ratio; a current-voltage converter generating the error voltage by converting the mirror current to a voltage; a comparator including a non-inversion terminal to which the error voltage is input and an inversion terminal to which the threshold voltage is input, outputting a first-level signal when the error voltage is higher than the threshold voltage, and outputting a second-level signal when the error voltage is lower than the threshold voltage; a delay unit generating a switch control signal by delaying an output signal of the comparator for the correction delay period; a switch turned on by the first-level switch control signal and turned off by the second-level switch control signal; and a clamping unit clamping the error amplifying signal to the error voltage. A first end of the capacitor is connected to an output terminal of the error amplifier and a first end of the switch, and when the switch is turned on, the first end of the capacitor is clamped to the error voltage by the clamping unit, and when the switch is turned off, the capacitor is charged/discharged according to the output voltage error. A first-end voltage of the capacitor is a voltage of the error amplifying signal.

The power factor correction circuit according to the exemplary embodiment of the present invention further includes an auxiliary inductor coupled with the inductor with a predetermined turn ratio, and the power factor correction controller determines a turn-on time of the power switch according to an auxiliary voltage that is a both-end voltage of the auxiliary inductor and determines a turn-off time of the power switch according to a comparison result of the error amplifying signal and a ramp signal having a predetermined cycle.

A driving method according to another exemplary embodiment of the present invention is provided to a power factor correction circuit re receiving an input voltage and generating an output voltage by controlling an inductor and a current flowing to the inductor. The driving method includes: generating an output voltage error according to a difference between the output voltage and a predetermined output voltage target level; controlling switching operation of the power switch according to the size of the output voltage error during a period in which the output voltage is lower than the output voltage target level and the output voltage is increasing; controlling the switching operation of the power switch according to an integration result of the output voltage error when the output voltage is constantly maintained at the output voltage target level; and controlling the switching operation of the power switch according to the size of the output voltage error during a predetermined correction delay period from a time that the output voltage is constantly maintained.

The controlling the switching operation of the power switch according to the size of the output voltage error includes: generating a detection current by detecting the output voltage error; mirroring the detection current; generating an error voltage by converting the mirrored current to a voltage; generating an error amplifying signal clamped to the error voltage; and determining a turn-off time of the power switch according to a comparison result of the error amplifying signal and a ramp signal that increases with a predetermined slope during a turn-on period of the power switch.

The controlling the switching operation of the power switch according to the integration result of the output voltage error includes generating an error amplifying signal by integrating the output voltage error and determining a turn-off time of the power switch according to a comparison result of the error amplifying signal and a ramp signal that increases with a predetermined slope during a turn-on period of the power switch.

A driving method according to another exemplary embodiment of the present invention is provided to a power factor correction circuit. The driving method includes: determining a control structure of the power factor correction circuit with respect to an output voltage according to an output voltage error that is a difference between an output voltage and a predetermined output voltage target level; controlling operation of the power factor correction circuit according to the size of the output voltage error when the control structure is a proportional control method; and controlling the operation of the power factor correction circuit by integrating the output voltage error when the control structure is a proportional-integral method. The proportional control method controls switching operation of a power switch of the power factor correction circuit according to the size of the output voltage error. The proportional-integral control method controls switching operation of a power switch of the power factor correction circuit according to an integration result of the output voltage error.

The determining the control structure of the power factor correction circuit includes comparing the output voltage error and a predetermined threshold value, determining the control structure with a proportional control method when the output voltage error is higher than the threshold value according to the comparison result, determining the control structure with a proportional-integral method when the output voltage error is lower than the threshold value according to the comparison result.

The determining the control structure of the power factor correction circuit further includes determining the control structure with the proportional control method during a predetermined correction delay period from a time that the output voltage error is lower than the threshold value.

The power factor correction circuit and the driving method according to the present invention minimize the influence of an over-voltage of the output voltage and a ripple component of an input voltage by quickening control response of the power factor correction control circuit during an increasing period of the output voltage and slowing the control response of the power factor correction control circuit when the output voltage is stabilized. Accordingly, the power factor correction circuit and the driving method provide a constant output voltage.

DETAILED DESCRIPTION OF THE EMBODIMENTS

Figure 1:
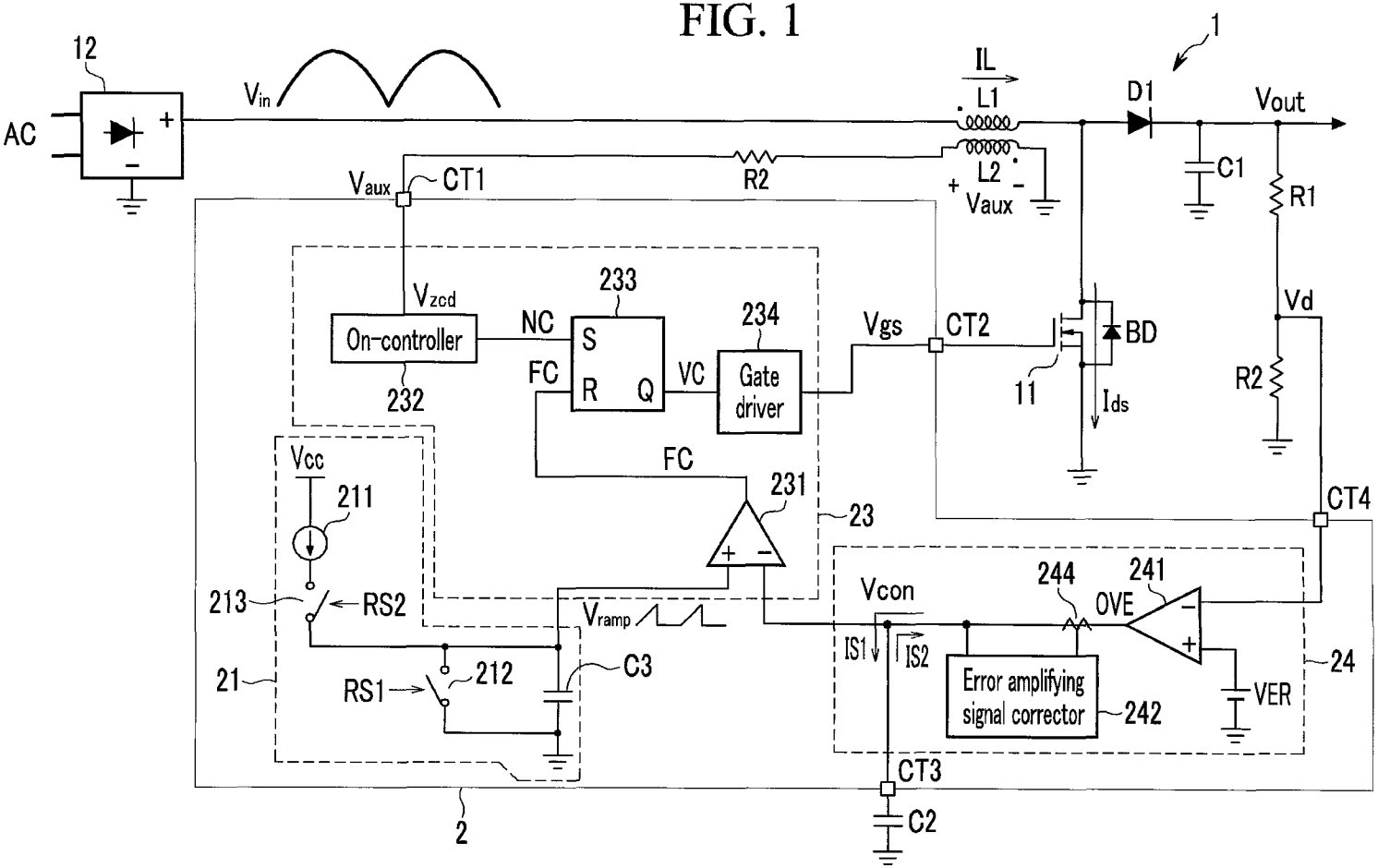
FIG. 1 shows a power factor correction circuit according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 shows a power factor correction circuit 1 according to an exemplary embodiment of the present invention.

As shown in FIG. 1, the power factor correction circuit 1 includes a power factor correction controller 2, a power switch 11, a bridge diode 12, a filter 13, a diode D1, a capacitor C1, an inductor L1, an auxiliary inductor L2, and division resistors R1 and R2. The power switch 11 according to the exemplary embodiment of the present invention is realized as a n-channel metal oxide semiconductor field effect transistor (NMOSFET). A body diode BD is formed between a drain electrode and a source electrode of the power switch 11. A current flowing in the power switch 11 is hereinafter referred to as a drain current Ids.

The bridge diode 12 is formed of four diodes (not shown), and generates an input voltage Vin by wave-rectifying an input AC power AC.

The input voltage Vin is supplied to a first end of the inductor L1, and a second end of the inductor L1 is connected to an anode of the diode D1.

The drain electrode of the power switch 11 is connected to the anode of the diode D1 and the second end of the inductor L1.

The inductor L1 receives the input voltage Vin and generates an output voltage. A switching operation of the power switch 11 controls the inductor current IL flowing in the inductor L1. With a triangle-shaped waveform, the inductor current is increased during a turn-on period of the power switch 11 and decreased during a turn-off period of the power switch 11, and the increase and decrease of the inductor current are repeated. In further detail, during the turn-on period of the power switch 11, the inductor current IL is increased and the inductor L1 stores energy. During the turn-off period of the power switch 11, the inductor current IL flows through the diode D1 and the energy stored in the inductor L1 is transmitted to the output end of the power factor correction circuit 1. When the power switch 11 is turned off and the diode D1 is connected, the inductor current IL flows to a load connected to the output end of the power factor correction circuit 1 and charges the capacitor C1. Since the inductor current IL supplied to the load connected to the output end of the power factor correction circuit 1 is increased as the load is increased, the current flowing to the capacitor C1 is decreased so that the output voltage Vout is decreased. On the contrary, when the load is decreased, the inductor current IL is decreased and the current flowing to the capacitor C1 is increased so that the output voltage Vout is increased.

When the power switch 11 is turned on, the diode D1 is disconnected and the inductor current IL flows through the power switch 11. The power factor correction controller 2 generates an error amplification signal by using a division voltage Vd divided according to a resistance ratio (R2/(R1+R2)) of the division resistors R1 and R2, and determines a turn-off time of the power switch 11 by comparing the error amplification signal Vcon with a ramp signal Vramp having a predetermined cycle. A turn-on time of the power switch 11 is determined according to a voltage (hereinafter referred to as an auxiliary voltage Vaux) of the auxiliary inductor L2.

The auxiliary inductor L2 is coupled to the inductor L1 with a predetermined turn ratio (turns of the auxiliary inductor L2/turns of the inductor L1). A voltage obtained by multiplying the both-end voltage of the inductor L1 by the turn ratio is the both-end voltage of the auxiliary inductor L2, and a current obtained by dividing the inductor current IL by the turn ratio flows in the auxiliary inductor L2.

When the power factor correction circuit 1 starts operation, the output voltage Vout of the power factor correction circuit 1 is increased and stabilized at a predetermined output voltage target level after a predetermined time has passed. A period from a time that the output voltage Vout starts to increase to a time before the output voltage Vout reaches the output voltage target level and is then stabilized is referred to as a start-up period, and a period after the output voltage Vout is stabilized is referred to as a stabilization period. A control structure of the power factor correction controller 2 according to the exemplary embodiment of the present invention varies according to the start-up period and the stabilization period. A control response for the output voltage Vout is determined according to the control structure of the power factor correction controller 2.

The control structure of the power factor correction controller 2 according to the exemplary embodiment of the present invention uses a proportional control method for controlling operation of the power factor correction circuit 1 according to the size of an output voltage error during the start-up period. The output voltage error is a difference between an output voltage target level set in design and a current output voltage Vout, and may have a positive value or a negative value. Since the output voltage Vout is increased until reaching the output voltage target level during the start-up period, the output voltage error has a positive value. Then, no delay occurs between variation of the output voltage Vout and the operation control of the power factor correction circuit 1 so that the control response of the power factor correction controller 2 is quickened.

This assumes that the power factor correction circuit 1 operates according to the proportional control method during the stabilization period, and an error occurs between the current output voltage and the output voltage target level. This error is referred to as a normal state error.

In order to solve the normal state error, the control structure of the power factor controller 2 according to the exemplary embodiment of the present invention can use a proportional-integral method during the stabilization period.

Thus, the power factor correction controller 2 calculates an output voltage error during the stabilization period and integrates the calculated output voltage error to control the operation of the power factor correction circuit 1 according to the integration result.

During the stabilization period, the output voltage Vout is set to a value that is close to the output voltage target level, and the output voltage error may have a positive or negative value. When the power factor correction controller 2 controls the power factor correction circuit 1 according to the proportional-integral method, the normal state error occurring when the proportional control method is used is integrated. Accordingly, the power factor correction circuit 1 is controlled in a way to reduce the normal state error.

However, since the output voltage error is integrated, variation of the output voltage may not be directly reflected to the operation control of the power factor correction circuit 1. That is, a delay occurs between the output voltage variation and the operation control of the power factor correction circuit 1. Accordingly, a response delay occurs between control of the power factor correction controller 2 and the output voltage of the power factor correction circuit 1. Since a low-frequency input voltage is input to the power factor correction circuit 1, the control response is slowed in order to eliminate the influence of the low-frequency input voltage. In this case, the time separation is further increased. The power factor correction circuit 1 according to the exemplary embodiment of the present invention solves this problem as follows.

The power factor correction circuit 1 generates a control output by processing the output voltage error according to the control structure. The control output is proportional to the output voltage error according to the proportional control method, and the control output is obtained by integrating the output voltage error according to the proportional-integral method. In further detail, the control output of the power factor correction circuit 1 according to the exemplary embodiment of the present invention is the error amplification signal Vcon of FIG. 1.

The control output is maintained at the peak level until before the output voltage Vout reaches the output voltage target level. However, when the output voltage Vout reaches the output voltage target level, the control output is rapidly decreased from the peak level. When the output voltage Vout reaches the output voltage target level, a period during which the output voltage is rapidly decreased is generated.

That is, a period during which the error amplification signal Vcon is maintained at the maximum value is the start-up period and a period during which the error amplification signal Vcon is rapidly decreased is the stabilization period, and this implies that an operation state of the power factor correction circuit 1 has been changed.

According to the exemplary embodiment of the present invention, the power factor correction controller 2 divides the start-up period and the stabilization period and generates the error amplification signal Vcon by changing the control structure for each period. In addition, the power factor correction controller 2 maintains the proportional control method during a predetermined correction delay period from a time that the start-up period ends and the stabilization period starts so as to solve the problem caused by the delay occurred between the output voltage variation and the operation control of the power factor correction circuit 1 during the stabilization period.

In further detail, the power factor correction controller 2 according to the exemplary embodiment of the present invention changes duty variation speed of the power switch according to the variation of the output voltage Vout through changing the control structure.

When the power factor correction controller 2 uses the proportional control method, the control response for the output voltage Vout is quickened so that duty of the power switch is changed faster than the variation of the output voltage Vout. When the power factor correction controller 2 uses the proportional-integral method, the control response for the output voltage Vout is slowed so that the duty is changed more slow than the variation of the output voltage Vout.

In the present exemplary embodiment, in the start-up period and the stabilization period according to the output voltage error, the power factor correction controller 2 generates the error amplification signal by using the proportional control method or the proportional-integral method according thereto. This will be described in detail later with reference to FIG. 2.

In the exemplary embodiment of the present invention, the power factor correction circuit is in a boundary conduction mode, and therefore resonance is generated between the inductor L1 and a parasitic capacitor (not shown) of the power switch 11 when the power switch 11 is turned off and the inductor current IL is zero. Then, the voltage of the inductor L1 is decreased in the sine-wave shape, and the auxiliary voltage Vaux is decreased. When the auxiliary voltage Vaux starts to decrease, the power factor correction controller 2 detects that the inductor current IL is zero and turns on the power switch 11 after a predetermined delay. In further detail, when the auxiliary voltage Vaux is decreased to a predetermined on-reference voltage level, the power switch 11 is turned on. Hereinafter, the power factor correction controller 2 will be described in further detail.

The power factor correction controller 2 includes a ramp signal generator 21, a PWM controller 23, and an error amplifying signal generator 24.

The error amplifying signal generator 24 generates an error amplification signal Vcon according to an output voltage error OVE. The error amplifying signal generator 24 generates an error amplification signal Vcon according to the amount of the output voltage error when an error voltage EV corresponding to the output voltage error OVE is higher than a predetermined threshold voltage. The threshold voltage is set for dividing the start-up period and the stabilization period according to the output voltage error OVE. During the start-up period, the error voltage EV is higher than the threshold voltage.

The error amplifying signal generator 24 generates the error amplification signal Vcon by integrating the output voltage error OVE when a correction delay period has passed from a time that the error voltage EV is lower than the threshold voltage. During the stabilization period, the error voltage EV is lower than the threshold voltage.

The error amplifying signal generator 24 generates the output voltage error OVE according to a difference between a reference voltage VER corresponding to the output voltage target level and the division voltage Vd. The output voltage error OVE is a current that is generated according to the difference between the reference voltage VER and the division voltage Vd, and becomes a sink current IS2 flowing to an error amplifier 24 from the capacitor C2 when the output voltage Vout is higher than the output voltage target level. When the output voltage Vout is lower than the output voltage target level, the output voltage error OVE becomes a source current IS1 flowing to the capacitor C2 from an error amplifier 241 (see FIG. 2).

Hereinafter, the error amplifying signal generator 24 according to the exemplary embodiment of the present invention will be described in further detail with reference to FIG. 2.

Figure 2:
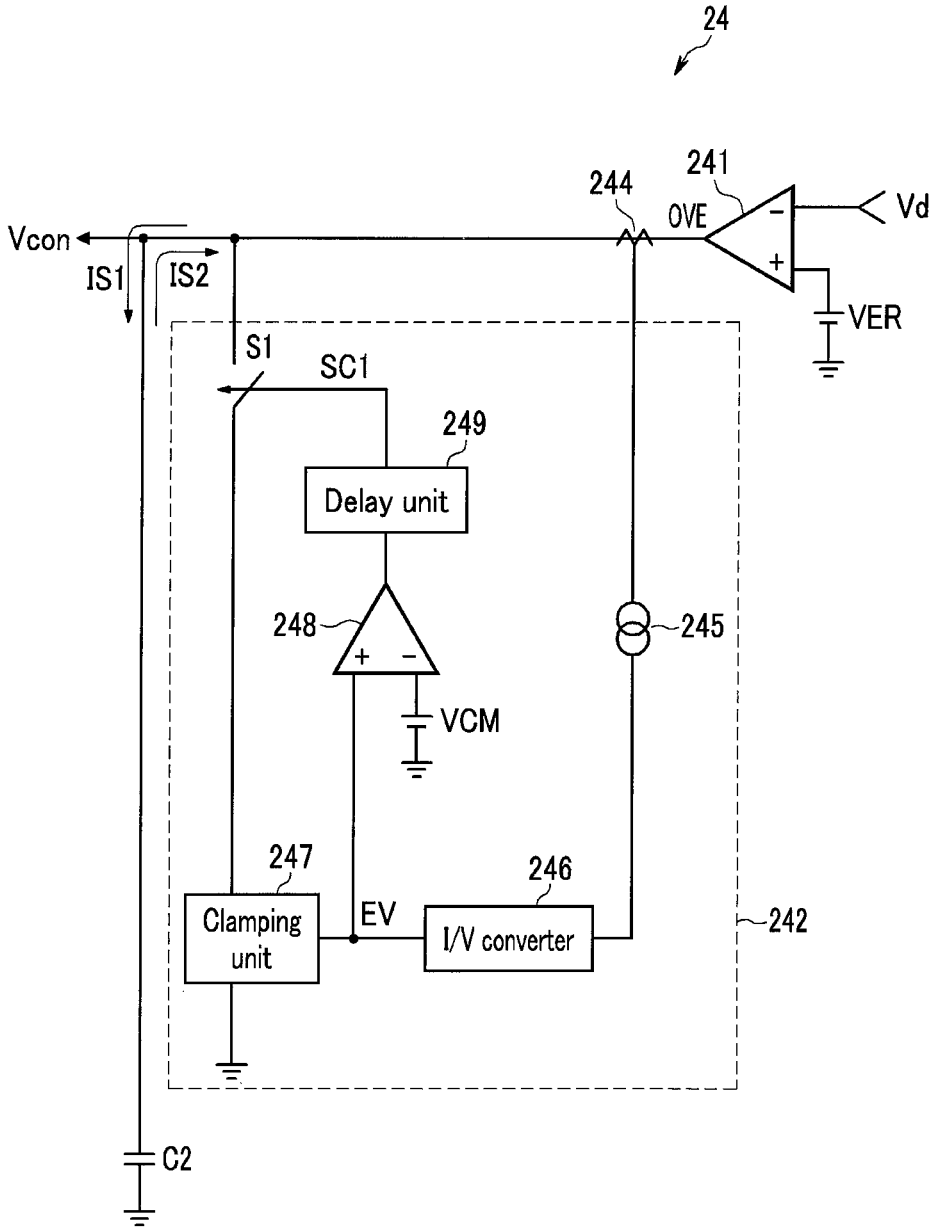
FIG. 2 shows an error amplifying signal generator according to the exemplary embodiment of the present invention.

FIG. 2 shows the error amplifying signal generator 24 according to the exemplary embodiment of the present invention. As shown in FIG. 2, the error amplifying signal generator 24 includes the error amplifier 241, an error amplification signal corrector 242, and the capacitor C2.

The error amplifier 241 includes an inversion (+) terminal to which the division voltage Vd is input and a non-inversion (−) terminal to which the reference voltage VER is input. The error amplifier 241 generates the output voltage error OVE that corresponds to a voltage obtained by subtracting the division voltage Vd from the reference voltage VER. When the division voltage Vd is higher than the reference voltage VER, the output voltage error OVE is the sink current IS2, and when the division voltage Vd is lower than the reference voltage VER, the output voltage error OVE is the source current IS1.

The error amplification signal corrector 242 generates the error voltage EV by detecting the output voltage error OVE, and generates the error amplification signal Vcon that is proportional to the output voltage error OVE when the error voltage EV is higher than a threshold voltage VCM. The error amplifying signal generator 24 generates the error amplification signal Vcon by integrating the output voltage error OVE with the error amplification signal Vcon when a correction delay period has passed from a time that the error voltage EV is lower than the threshold voltage VCM.

The error amplification signal corrector 242 includes a current detector 244, a current mirror circuit 245, an IN converter 246, a clamping unit 247, a comparator 248, and a delay unit 249.

The current detector 244 generates a detection current corresponding to the output voltage error OVE by detecting the output voltage error OVE.

The current mirror circuit 245 mirrors the detection current with a predetermined ratio. The mirrored current is transmitted to the IN converter 246.

The I/V converter 246 converts the mirrored current to a voltage to generate the error voltage EV.

The comparator 248 includes a non-inversion terminal to which the error voltage EV is input and an inversion terminal to which the threshold voltage VCM is input, outputs a high-level signal when the error voltage EV is higher than the threshold voltage VCM, and outputs a low-level signal when the error voltage EV is lower than the threshold voltage VCM.

The delay unit 249 generates a switch control signal SC1 by delaying the output signal of the comparator 248 for a correction delay period Cdelay and outputs the generated signal. The switch S1 is turned on by a high-level switch control signal, and is turned off by a low-level switch control signal.

The clamping unit 247 clamps a voltage at the capacitor C2 to a value that follows the error voltage EV during the turn-on period of the switch S1. That is, the clamping unit 247 clamps the error amplification signal Vcon to the error voltage EV. Then, since the error amplification signal Vcon is equivalent to the error voltage EV, the error amplification signal Vcon is generated according to the proportional control method.

A first end of the capacitor C2 is connected to a first end of the switch S1 and an output end of the error amplifier 241, and a second end thereof is grounded. The capacitor C2 is charged or discharged according to the output voltage error OVE when the switch S1 is turned off, and a voltage of the error amplification signal Vcon is determined according to a first-end voltage of the capacitor C2. When the output voltage error OVE is a source current, the capacitor C2 is charged, and when the output voltage error OVE is a sink current, the capacitor C2 is discharged. When the switch S1 is turned on, the output voltage of the clamping unit 247 becomes the first-end voltage of the capacitor C2.

The correction delay period Cdelay is a period during which the proportional control method is maintained from a time that the output voltage Vout is changed from the start-up period to the stabilization period. During the correction delay period Cdelay, an over-shoot of the output voltage Vout is prevented. Therefore, the error amplification signal Vcon is generated according to the proportional control method during the correction delay period Cdelay.

Since a delay occurs according to the proportional-integral method, variation of the error amplification signal with respect to output voltage variation of the power factor correction circuit 1 is delayed if the error amplification signal is generated by using the proportional-integral control method at a time that the stabilization period starts. Then, the over-shoot of the output voltage occurs during a delay period due to the proportional-integral control method. That is, the proportional-integral control method has a problem that an error amplification signal that is synchronized at the stabilization period and decreased rapidly cannot be generated. This causes an over-voltage due to the over-shoot of the output voltage of the power factor correction circuit 1.

In order to prevent this, the present invention rapidly decreases the error amplifying signal Vcon by further maintaining the error amplifying signal Vcon based on the proportional control method for a correction delay period Cdelay from a beginning time of the stabilization period. Operation of the error amplification signal corrector 242 will be described in further detail later with reference to FIG. 3 to FIG. 6.

The ramp signal generator 21 generates a ramp signal Vramp that is increased with a predetermined slope during the turn-on period of the power switch 11. The ramp signal generator 21 includes a constant current source 211, a discharge switch 212, a charge switch 213, and a capacitor C3. A first end of the charge switch 213 is connected to a first end of the constant current source 211, and a second end of the charge switch 213 is connected to a first end of the discharge switch 212 and a first end of the capacitor C3. The discharge switch 212 and the capacitor C3 are connected in parallel, and a second end of the discharge switch 212 and a second end of the capacitor C3 are grounded. During the turn-on period of the power switch 11, the charge switch 213 is turned on by a switching signal RS2 and the discharge switch 212 is turned off by a switching signal RS1. Then, a current of the constant current source 211 charges the capacitor C3 and the ramp signal Vramp is increased with a slope according to the current of the constant current source 211. During the turn-off period of the power switch 11, the charge switch 213 is turned off by the switching signal RS2 and the discharge switch 212 is turned on by the switching signal RS1. Then, the current of the constant current source 211 is blocked and the capacitor C3 is discharged so that the ramp signal Vramp is rapidly discharged and then becomes a ground voltage.

The PWM controller 23 generates a gate control signal Vgs for controlling the switching operation of the power switch 11 by using the auxiliary voltage Vaux, the ramp signal Vramp, and the error amplification signal Vcon. The PWM controller 23 includes a PWM comparator 231, an on-controller 232, a PWM flip-flop 233, and a gate driver 234.

The PWM comparator 231 generates an off-control signal FC by comparing the ramp signal Vramp and the error amplification signal Vcon. The PWM comparator 231 includes a non-inversion (+) terminal to which the ramp signal Vramp is input and an inversion (−) terminal to which the error amplification signal Vcon is input. The PWM comparator 231 generates a high-level comparison result signal CC when the ramp signal Vramp is higher than the error amplification signal Vcon, and generates a low-level comparison result signal CC when the ramp signal Vramp is lower than the error amplification signal Vcon. Thus, when the increasing ramp signal Vramp reaches the error amplification signal Vcon, a high-level off-control signal FC is output.

The on-controller 232 generates an on-control signal NC for turning on the power switch 11 according to the auxiliary voltage Vaux. The on-controller 232 is synchronized at an on-control time when the auxiliary voltage Vaux that decreases after the power switch 11 is turned off is lower than a predetermined on-reference voltage and generates the on-control signal NC having a high-level pulse.

The PWM flip-flop 233 generates a gate driver control signal VC for controlling the switching operation of the power switch 11 according to the on-control signal NC and the off-control signal FC. The PWM flip-flop 233 includes a set terminal S to which the on-control signal NC is input and a reset terminal R to which the off-control signal FC is input. The PWM flip-flop 233 outputs a high-level gate driver control signal VC through an output terminal Q when a high-level signal is input to the set terminal S. The PWM flip-flop 233 outputs a low-level gate driver control signal VC through the output terminal Q when a high-level signal is input to the reset terminal R. When the signals input to the set terminal S and the reset terminal R are low-level signals, the PWM flip-flop 233 maintains a current gate driver control signal VC.

The gate driver 234 generates the gate signal Vgs that switches the power switch 11 according to the gate driver control signal VC. The gate driver 234 generates a high-level gate signal Vgs for turning on the power switch 11 when a high-level gate driver control signal VC is input, and generates a low-level gate signal Vfs for turning off the power switch 11 when a low-level gate driver control signal VC is input.

Figure 3:
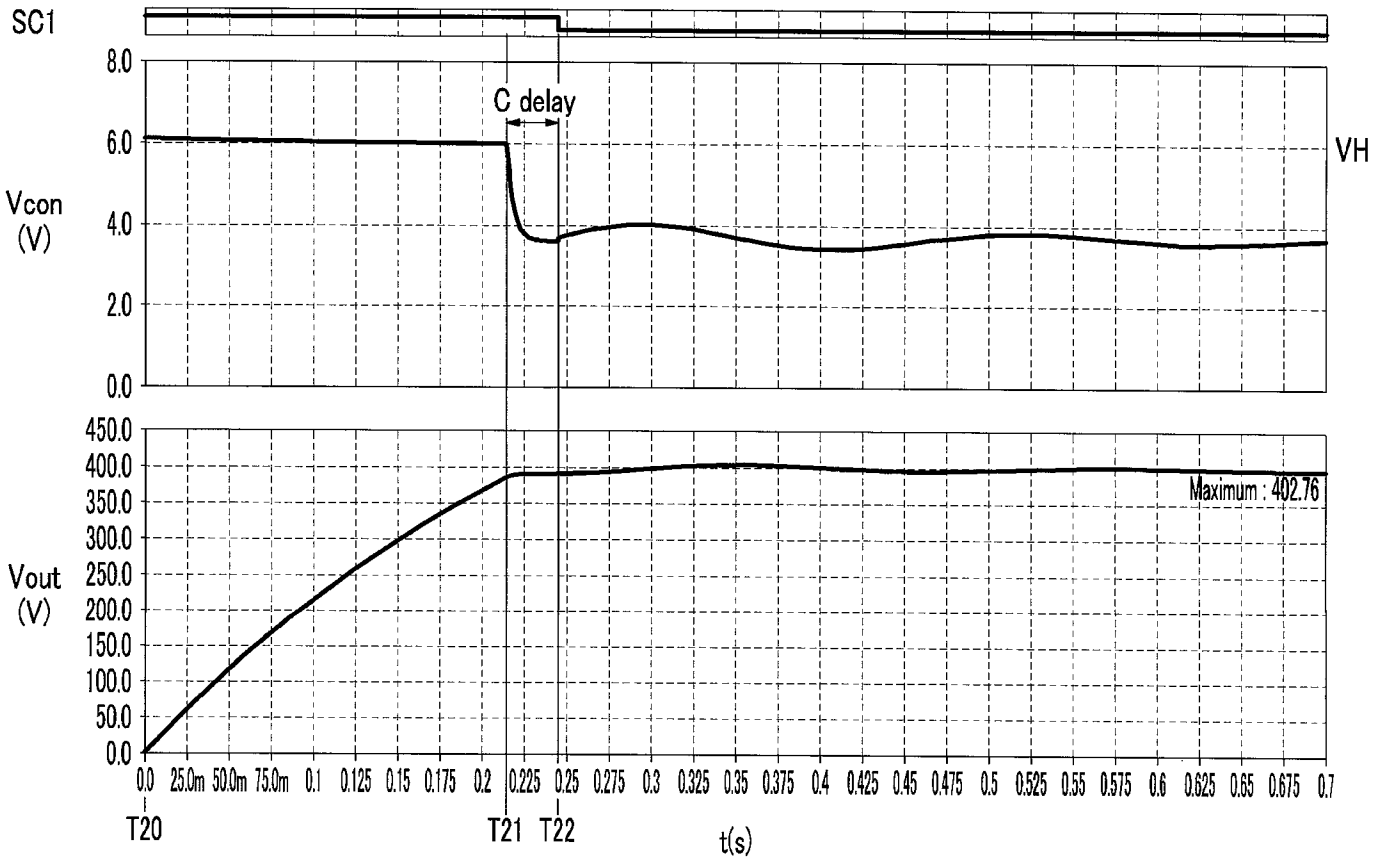
FIGS. 3 and 4 show a relationship between an output voltage and an error amplifying signal at start-up operation of the power factor correction circuit and a switch control signal according to the exemplary embodiment of the present invention.
Figure 4:
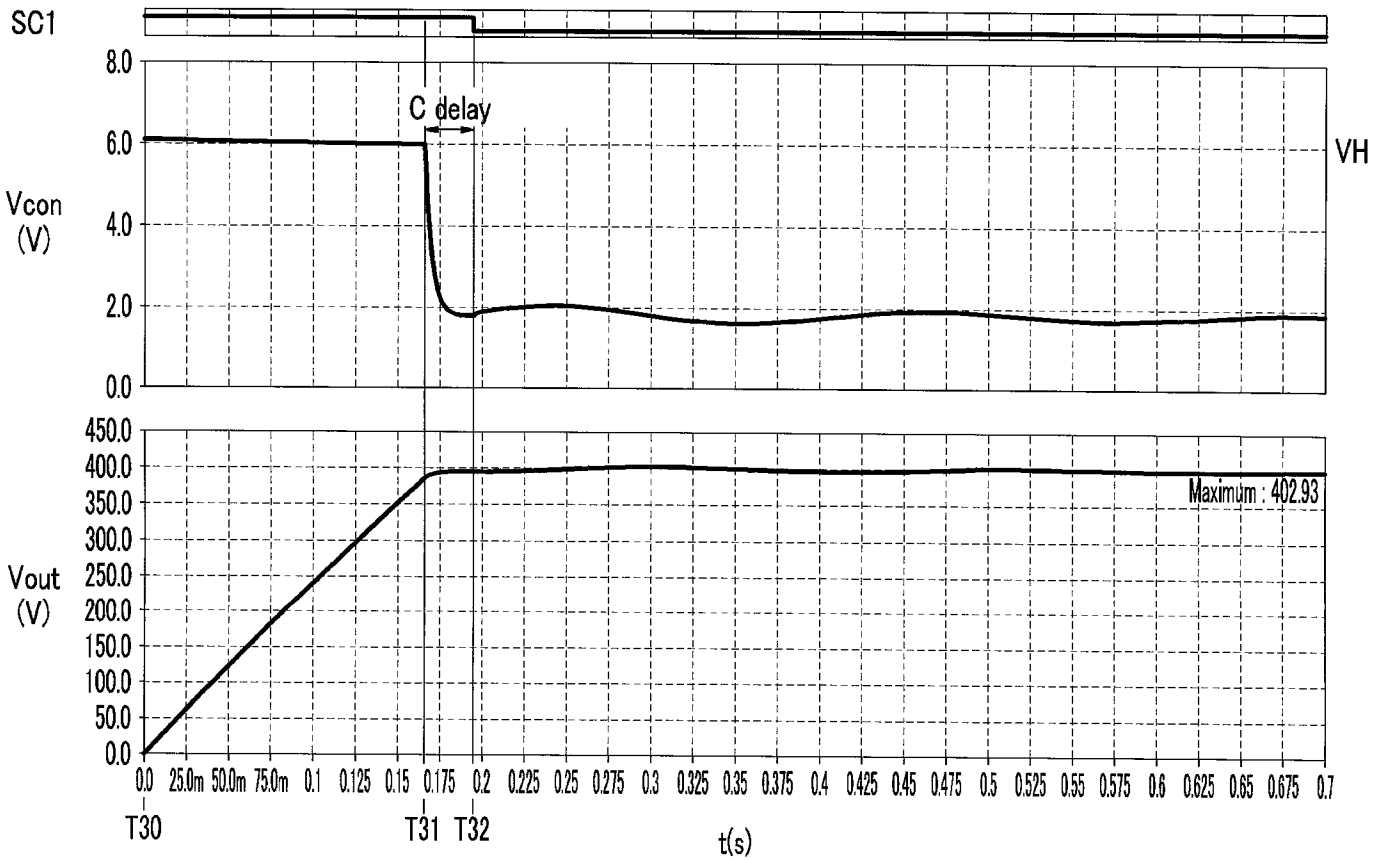

FIG. 3 and FIG. 4 show a relationship between the output voltage Vout and the error amplification signal Vcon at the start-up operation of the power factor correction circuit 1 and the switch control signal SC1 according to the exemplary embodiment of the present invention.

Figure 5:
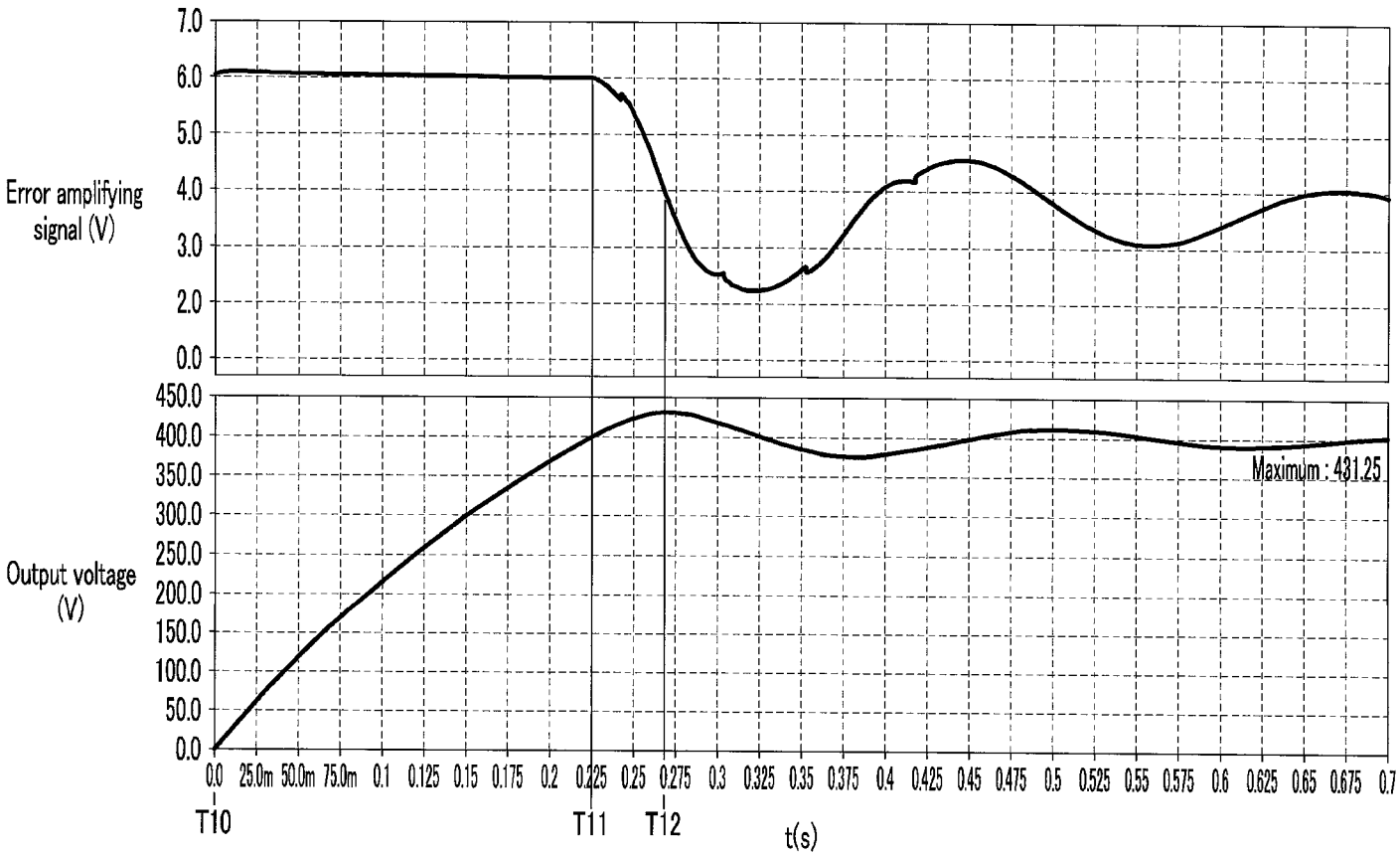
FIG. 5 and FIG. 6 show a relationship between an output voltage and an error amplifying signal when an over-shoot of an output voltage occurs at start-up operation of a conventional power factor correction circuit.
Figure 6:
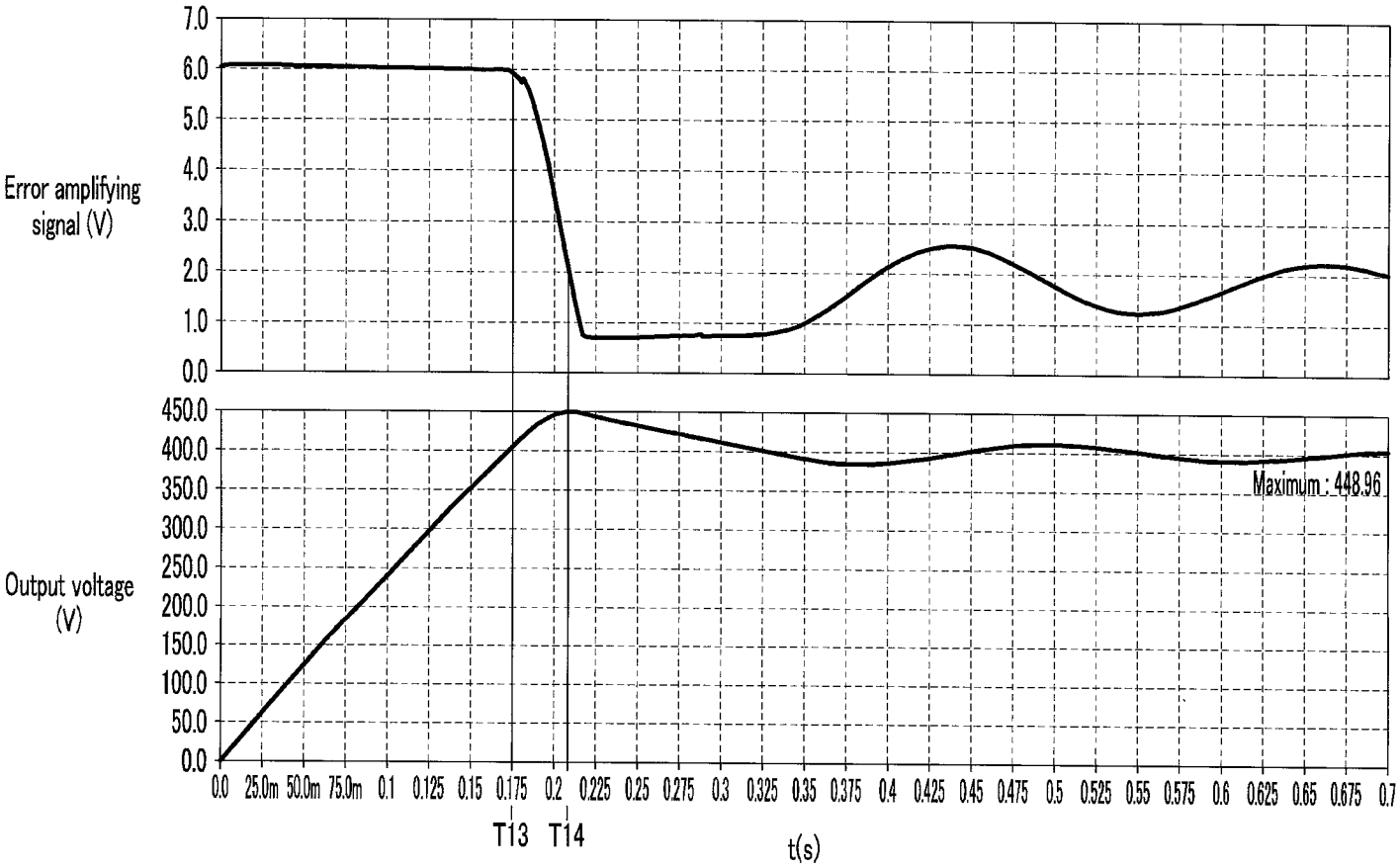

FIG. 5 and FIG. 6 show a relationship between an output voltage and an error amplification signal when an over-shoot of an output voltage occurs at start-up operation of a conventional power factor correction circuit. FIG. 5 and FIG. 6 are provided for describing the effect of the power factor correction circuit according to the exemplary embodiment of the present invention.

A conventional power factor correction circuit that does not have error amplification signal correction of the exemplary embodiment of the present invention will be described first. In FIG. 5 and FIG. 6, a target voltage level is 400V, a load of FIG. 5 is a heavy load, and a load of FIG. 6 is a light load.

In FIG. 5, the output voltage reaches 400V at a time T11 and an error amplification signal starts to decrease after the time T11. However, the output voltage is increased until a time T12 because the error amplification signal is decreased with an easy slope. Then, the output voltage is increased to 431V.

In FIG. 6, the output voltage reaches 400V at a time T13 and the error amplification signal starts to decrease after the time T13. Although the error amplification signal is decreased with a steeper slope compared to FIG. 5, the output voltage is increased until T14. Then, the output voltage is increased to 448V.

That is, an over-shoot of the output voltage cannot be prevented with a decrease slope after the stabilization periods T11 and T13 in the conventional power factor correction circuit.

FIG. 3 shows a relationship between the error amplification signal Vcon and the output voltage Vout according to the exemplary embodiment of the present invention under the same conditions as FIG. 5. FIG. 4 shows a relationship between the error amplification signal Vcon and the output voltage Vout according to the exemplary embodiment of the present invention under the same conditions as FIG. 6.

Since the switch S1 is in the turn-on state from a time T20 when the output voltage Vout starts to increase to a time T21, the error amplification signal Vcon is determined according to the error voltage EV.

The output voltage Vout is close to the output voltage target level after the time T21, and therefore the output voltage error OVE is rapidly decreased. Then, the error voltage EV is rapidly decreased and the error amplification signal Vcon is also rapidly decreased.

Accordingly, the error voltage EV is lower than the threshold voltage VCM after the time T21. The comparator 248 outputs a low-level signal at the time T21, and the delay unit 249 turns off the switch S1 at a time T22 that is delayed for the correction delay period Cdelay.

Then, the error amplification signal Vcon has a voltage level that is obtained by integrating the output voltage error OVE after the time T22 with the error amplification signal Vcon at the time T22. After the time T22, the error amplification signal Vcon is generated according to the proportional-integral method and the output voltage Vout is controlled to the output voltage target level.

Generally, a case of a light load is the same as the case described with reference to FIG. 3.

Since the switch S1 is in the turn-on state from a time that the output voltage Vout starts to increase to a time T31, the error amplification signal Vcon is determined according to the error voltage EV.

The output voltage Vout is close to the output voltage target level after the time T31, and therefore the output voltage error OVE is rapidly decreased. Then, the error voltage EV is rapidly decreased and the error amplification signal Vcon is also rapidly decreased.

Accordingly, the error voltage EV is lower than the threshold voltage VCM after the time T31. The comparator 248 outputs a low-level signal at a time T32, and the delay unit 249 turns off the switch S1 at the time T32 that is delayed for the correction delay period Cdelay.

Then, the error amplification signal Vcon has a voltage level that is obtained by integrating the output voltage error OVE after the time T32 with the error amplification signal Vcon at the time T32. After the time T32, the error amplification signal Vcon is generated according to the proportional-integral method and the output voltage Vout is controlled to the output voltage target level.

As shown in FIG. 3 and FIG. 4, a period between the time T21 (or T31) when the error amplification signal Vcon becomes lower than the threshold voltage may be classified as the start-up period, and a period after the time T21 (or T31) may be classified as the stabilization period. In the exemplary embodiment of the present invention, the error amplification signal Vcon is rapidly decreased by generating the error amplification signal Vcon by using the proportional-integral method at the early stage of the stabilization period. Then, the over-shoot of the output voltage Vout can be prevented.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A power factor correction circuit comprising:

an inductor receiving an input voltage and supplying an output voltage;

a power switch connected to the inductor and controlling an inductor current flowing to the inductor; and a power factor correction controller differentiating a stabilization period during which the output voltage is constantly maintained from a start-up period during which the output voltage is increased before being stabilized, controlling the switching operation of the power switch according to a first control structure during the stabilization period, controlling the switching operation of the power switch according to a second control structure during the start-up period, and controlling the switching operation of the power switch according to the second control structure during a predetermined correction delay period from a time that the stabilization period starts, the first control structure and the second control structure being different control structures, the second control structure providing a control response for the output voltage that is faster than a control response for the output voltage that is provided by the first control structure.

2. The power factor correction circuit of claim 1, wherein the second control structure is a proportional control method that controls the switching operation of the power switch according to a size of an output voltage error, and the output voltage error corresponds to a difference between an output voltage target level and a current value of the output voltage of the power factor correction circuit.

3. The power factor correction circuit of claim 2, wherein the first control structure is a proportional-integral method that controls the switching operation of the power switch according to an integration result of the output voltage error.

4. The power factor correction circuit of claim 2, wherein the power factor correction controller comprises an error amplification signal generator that generates an error amplification signal according to the output voltage error, and the error amplifying signal generator generates the error amplification signal according to the size of the output voltage error during a period in which an error voltage corresponding to the output voltage error is higher than a predetermined threshold voltage and a period from a time that the error voltage is lower than the threshold voltage to the correction delay period and generates the error amplification signal by integrating the output voltage error after the correction delay period.

5. The power factor correction circuit of claim 4, wherein the error amplifying signal generator comprises:

an error amplifier generating the output voltage error according to a difference between a division voltage corresponding to the output voltage and a reference voltage corresponding to the output voltage target level;

an error amplifying signal corrector generating the error voltage by detecting the output voltage error and generating an error amplifying signal according to the size of the output voltage error during a period in which the error voltage is higher than the threshold voltage and the correction delay period; and a capacitor charged/discharged according to the output voltage error, and the error amplifying signal is determined by a voltage charged at the capacitor after the correction delay period from a time that the error voltage is lower than the threshold voltage.

6. The power factor correction circuit of claim 5, wherein the error amplifying signal generator comprises:

a current detector generating a detection current corresponding to an output voltage error by detecting the output voltage error;

a current mirror circuit generating a mirror current by mirroring the detection current with a predetermined ratio;

a current-voltage converter generating the error voltage by converting the mirror current to a voltage;

a comparator including a non-inversion terminal to which the error voltage is input and an inversion terminal to which the threshold voltage is input, outputting a first-level signal when the error voltage is higher than the threshold voltage, and outputting a second-level signal when the error voltage is lower than the threshold voltage;

a delay unit generating a switch control signal by delaying an output signal of the comparator for the correction delay period;

a switch turned on by the first-level switch control signal and turned off by the second-level switch control signal; and a clamping unit clamping the error amplifying signal to the error voltage.

7. The power factor correction circuit of claim 6, wherein a first end of the capacitor is connected to an output terminal of the error amplifier and a first end of the switch, and when the switch is turned on, the first end of the capacitor is clamped to the error voltage by the clamping unit, and when the switch is turned off, the capacitor is charged/discharged according to the output voltage error.

8. The power factor correction circuit of claim 7, wherein a first-end voltage of the capacitor is a voltage of the error amplifying signal.

9. The power factor correction circuit of claim 1, further comprising an auxiliary inductor coupled with the inductor with a predetermined turn ratio, wherein the power factor correction controller determines a turn-on time of the power switch according to an auxiliary voltage that is a both-end voltage of the auxiliary inductor and determines a turn-off time of the power switch according to a comparison result of the error amplifying signal and a ramp signal having a predetermined cycle.

10. A driving method of a power factor correction circuit receiving an input voltage and generating an output voltage by controlling an inductor and a current flowing to the inductor, comprising:

generating an output voltage error according to a difference between the output voltage and a predetermined output voltage target level;

controlling switching operation of the power switch according to a size of the output voltage error during a period in which the output voltage is lower than the output voltage target level and the output voltage is increasing;

controlling the switching operation of the power switch according to an integration result of the output voltage error when the output voltage is constantly maintained at the output voltage target level; and controlling the switching operation of the power switch according to the size of the output voltage error during a predetermined correction delay period from a time that the output voltage is constantly maintained.

11. The driving method of claim 10, wherein the controlling the switching operation of the power switch according to the size of the output voltage error comprises:

generating a detection current by detecting the output voltage error;

mirroring the detection current;

generating an error voltage by converting the mirrored current to a voltage;

generating an error amplifying signal clamped to the error voltage; and determining a turn-off time of the power switch according to a comparison result of the error amplifying signal and a ramp signal that increases with a predetermined slope during a turn-on period of the power switch.

12. The driving method of claim 10, wherein the controlling the switching operation of the power switch according to the integration result of the output voltage error comprises:

generating an error amplifying signal by integrating the output voltage error; and determining a turn-off time of the power switch according to a comparison result of the error amplifying signal and a ramp signal that increases with a predetermined slope during a turn-on period of the power switch.

13. A driving method of a power factor correction circuit, comprising:

determining a control structure of the power factor correction circuit with respect to an output voltage according to an output voltage error that is a difference between an output voltage and a predetermined output voltage target level;

controlling operation of the power factor correction circuit according to a size of the output voltage error when the control structure is a proportional control method during a start-up period during which the output voltage is increased before being stabilized;

controlling the operation of the power factor correction circuit by integrating the output voltage error when the control structure is a proportional-integral method during a stabilization period during which the output voltage is constantly maintained; and controlling the operation of the power factor correction circuit according to the proportional control method during a predetermined delay period from a time that the stabilization period starts.

14. The driving method of claim 13, wherein the determining the control structure of the power factor correction circuit comprises:

comparing the output voltage error and a predetermined threshold value;

determining the control structure with the proportional control method when the output voltage error is higher than the threshold value according to the comparison result; and determining the control structure with the proportional-integral method when the output voltage error is lower than the threshold value according to the comparison result.

15. The driving method of claim 14, wherein the determining the control structure of the power factor correction circuit further comprises determining the control structure with the proportional control method during a predetermined correction delay period from a time that the output voltage error is lower than the threshold value.

16. The driving method of claim 13, wherein the proportional control method controls switching operation of a power switch of the power factor correction circuit according to the size of the output voltage error.

17. The driving method of claim 13, wherein the proportional-integral control method controls switching operation of a power switch of the power factor correction circuit according to an integration result of the output voltage error.

* * * * *